US010414014B2

(12) United States Patent
Hafele et al.

(10) Patent No.: US 10,414,014 B2
(45) Date of Patent: Sep. 17, 2019

(54) MULTIFUNCTION ROTARY TOOL INCLUDING DRIVESHAFT

(71) Applicant: Campbell Hausfeld, LLC, Harrison, OH (US)

(72) Inventors: Nicholas Steven Hafele, Cincinnati, OH (US); Brandon Lee Cross, Centerville, OH (US)

(73) Assignee: Campbell Hausfeld, LLC, Harrison, OH (US)

( * ) Notice: Subject to any disclaimer, the term of this patent is extended or adjusted under 35 U.S.C. 154(b) by 172 days.

(21) Appl. No.: 15/709,201

(22) Filed: Sep. 19, 2017

(65) Prior Publication Data

US 2019/0084116 A1 Mar. 21, 2019

(51) Int. Cl.

| | |
|---|---|
| ***B24B 23/00*** | (2006.01) |
| ***B24B 23/03*** | (2006.01) |
| *B24B 23/02* | (2006.01) |

(52) U.S. Cl.

CPC ..... *B24B 23/03* (2013.01); *B24B 23/026* (2013.01)

(58) Field of Classification Search

CPC ..... B24B 23/03; B24B 23/026; B24B 45/00; B24B 45/006; F16D 11/14; F16D 1/10; F16D 2001/102; Y10T 403/7016; Y10T 403/7045

USPC ..... 451/155, 169, 342, 360

See application file for complete search history.

(56) References Cited

U.S. PATENT DOCUMENTS

| | | | | |
|---|---|---|---|---|
| 1,653,108 | A * | 12/1927 | Koenig | B24B 23/02 15/230 |
| 2,794,303 | A | 6/1957 | Wickes | |
| 3,084,364 | A * | 4/1963 | Hutchins | A47L 11/38 15/230.19 |
| 3,205,622 | A * | 9/1965 | Leveque | B24B 23/03 451/271 |
| 3,364,625 | A | 1/1968 | Sogge | |
| 3,482,362 | A | 12/1969 | Bangerter et al. | |
| 4,102,084 | A * | 7/1978 | Bloomquist | B24B 23/03 451/295 |
| 4,470,225 | A | 9/1984 | Darling et al. | |
| 4,610,111 | A * | 9/1986 | Cox | B24B 23/02 279/6 |
| 4,727,682 | A | 3/1988 | Stabler et al. | |
| 4,754,575 | A | 7/1988 | Schneider | |
| 4,989,374 | A * | 2/1991 | Rudolf | B24B 23/022 451/342 |

(Continued)

FOREIGN PATENT DOCUMENTS

| | | |
|---|---|---|
| DE | 10119133 A1 | 10/2002 |
| DE | 10330122 A1 | 2/2005 |

(Continued)

OTHER PUBLICATIONS

Hafele, Nicholas Steven et al; U.S. Appl. No. 15/709,197; Title: Multifunction Rotary Tool Including Hub; Filed: Sep. 19, 2017.

*Primary Examiner* — George B Nguyen

(74) *Attorney, Agent, or Firm* — Banner & Witcoff, Ltd.

(57) ABSTRACT

A handheld multifunction power tool includes a driveshaft, a hub assembly, and a stem. The hub assembly includes an outer hub and an inner hub that is rotatably coupled with the inner hub and rotatable with respect to the outer hub. Rotation of the inner hub relative to the outer hub facilitates selection from among a rotary mode and a random orbital mode.

20 Claims, 15 Drawing Sheets

(56) References Cited

U.S. PATENT DOCUMENTS 5,165,204 A * 11/1992 Luedeke ..... B24B 21/002 269/58
5,235,716 A * 8/1993 Stella ..... A46B 7/04 15/23
5,301,471 A * 4/1994 Fisher ..... B24B 23/026 15/97.1
5,349,786 A * 9/1994 Dorrah ..... B24B 23/03 451/357
5,441,450 A 8/1995 Fein et al.
5,947,804 A 9/1999 Fukinuki et al.
6,306,024 B1 10/2001 Kai et al.
6,312,322 B1 * 11/2001 Chang ..... B24B 23/03 451/344
6,475,066 B2 11/2002 Panagian
6,632,128 B2 * 10/2003 Berger ..... B24B 23/028 451/344
6,749,493 B2 6/2004 Wuensch
7,029,385 B1 * 4/2006 Wang ..... B24B 23/03 451/270
7,238,095 B1 * 7/2007 Sun ..... B24B 23/026 173/104
7,530,881 B2 5/2009 Zhong
7,721,861 B2 5/2010 Zhong
8,172,650 B2 * 5/2012 Caryk ..... B25F 5/001 451/357
8,187,058 B2 * 5/2012 Blickle ..... B24B 45/006 451/342
8,517,799 B2 * 8/2013 Panergo ..... B24B 19/26 451/28
2002/0013126 A1 * 1/2002 Raso ..... B24B 35/00 451/441
2004/0248505 A1 * 12/2004 Chen ..... B24B 23/026 451/340
2007/0021044 A1 * 1/2007 Allemann ..... A61C 3/06 451/342
2007/0060030 A1 * 3/2007 Pollak ..... B24B 45/006 451/359
2007/0167120 A1 * 7/2007 Habele ..... B24B 45/006 451/359
2008/0057842 A1 * 3/2008 Lampka ..... B24B 23/022 451/357
2010/0151775 A1 * 6/2010 Lampka ..... B24B 23/022 451/357
2010/0197208 A1 * 8/2010 Blickle ..... B24B 23/02 451/342
2011/0036604 A1 2/2011 Worsnop et al.
2014/0187127 A1 * 7/2014 Zapp ..... B24B 23/03 451/59
2014/0194040 A1 * 7/2014 Cheng ..... B24B 23/04 451/357

FOREIGN PATENT DOCUMENTS

DE 102004055271 A1 5/2006
DE 102006031658 A1 1/2008
EP 0230621 A2 8/1987
EP 2366493 A1 9/2011
EP 2366494 A1 9/2011
EP 2366495 A1 9/2011
JP S63156652 A 6/1988
WO 974200 A1 11/1997

* cited by examiner

MULTIFUNCTION ROTARY TOOL INCLUDING DRIVESHAFT

TECHNICAL FIELD

This application relates generally to a multifunction rotary tool for treating a surface. In particular, this application relates to a handheld multifunction power sander that is capable of orbital sanding, random orbital sanding, and rotary sanding.

BACKGROUND

Conventional handheld multifunction sanding tools enable a user to employ different sanding operations, such as orbital sanding and rotary orbiting sanding, for example, using the same tool. Selecting from among these different sanding functions can be cumbersome, time consuming, and can often require the use of tools. These conventional handheld multifunction sanding tools also lack the ability to select from among orbital sanding, random orbital sanding, and rotary sanding.

SUMMARY

In accordance with one embodiment, a handheld multifunction rotary tool comprises a housing, a rotary motor, a driveshaft, and a stem. The rotary motor is disposed at least partially within the housing and is rotatable with respect to the housing about a drive axis. The driveshaft is operably coupled with the rotary motor and comprises a drive member and a tip portion slidably coupled with the drive member. The tip portion is slidable with respect to the drive member between a retracted position and an extended position. The stem is rotatably coupled with the driveshaft and is rotatable with respect to the driveshaft. The stem is configured to receive a surface treatment device. When the tip portion of the driveshaft is in the retracted position, the tip portion is disengaged from the stem such that the stem is free to rotate with respect to the driveshaft. When the tip portion of the driveshaft is in the extended position, the tip portion is engaged with the stem such that the stem rotates together with the driveshaft.

In accordance with another embodiment, a drive assembly for a multifunction rotary tool is provided. The drive assembly comprises a driveshaft, an outer hub, and a stem. The driveshaft comprises a drive member and a tip portion slidably coupled with the drive member. The driveshaft is rotatable about a drive axis. The tip portion is slidable with respect to the drive member between a retracted position and an extended position. The outer hub defines a first receptacle that defines a first centerline. The inner hub is disposed in the first receptacle and defines a second receptacle. The inner hub is rotatable with respect to the outer hub about the first centerline between a first position and a second position. The stem is at least partially disposed within the second receptacle and is rotatably coupled with the inner hub. The stem is configured to receive a surface treatment device. The driveshaft extends through a portion of each of the outer hub and the inner hub and into the second receptacle such that the stem is accessible to the tip portion to facilitate selective engagement between the tip portion and the stem. When the tip portion of the driveshaft is in the retracted position, the tip portion is disengaged from the stem such that the stem is free to rotate with respect to the driveshaft. When the tip portion of the driveshaft is in the extended position, the tip portion is engaged with the stem such that the stem rotates together with the driveshaft.

In accordance with another embodiment, a drive assembly for a multifunction rotary tool is provided. The drive assembly comprises a driveshaft, a hub, and a stem. The driveshaft comprises a drive member and a tip portion slidably coupled with the drive member. The tip portion is slidable with respect to the drive member between a retracted position and an extended position. The hub is rotatably coupled with the driveshaft and is rotatable between a first position and a second position. The hub comprises a main body and a pair of shoulders disposed along an upper surface of the main body and spaced from each other to define a slot. The upper surface defines an access hole between the pair of shoulders at the slot. The stem is rotatably coupled with the hub and is configured to receive a surface treatment device. When the hub is in the first position, the tip portion is aligned with the slot and is in the extended position, such that the tip portion extends through the access hole and into engagement with the stem. When the hub is in the second position, the tip portion is misaligned with the slot and rests on the pair of shoulders in the retracted position such that the tip portion is disengaged from the stem.

BRIEF DESCRIPTION OF THE DRAWINGS

It is believed that certain embodiments will be better understood from the following description taken in conjunction with the accompanying drawings in which.

DETAILED DESCRIPTION

Figure 1:
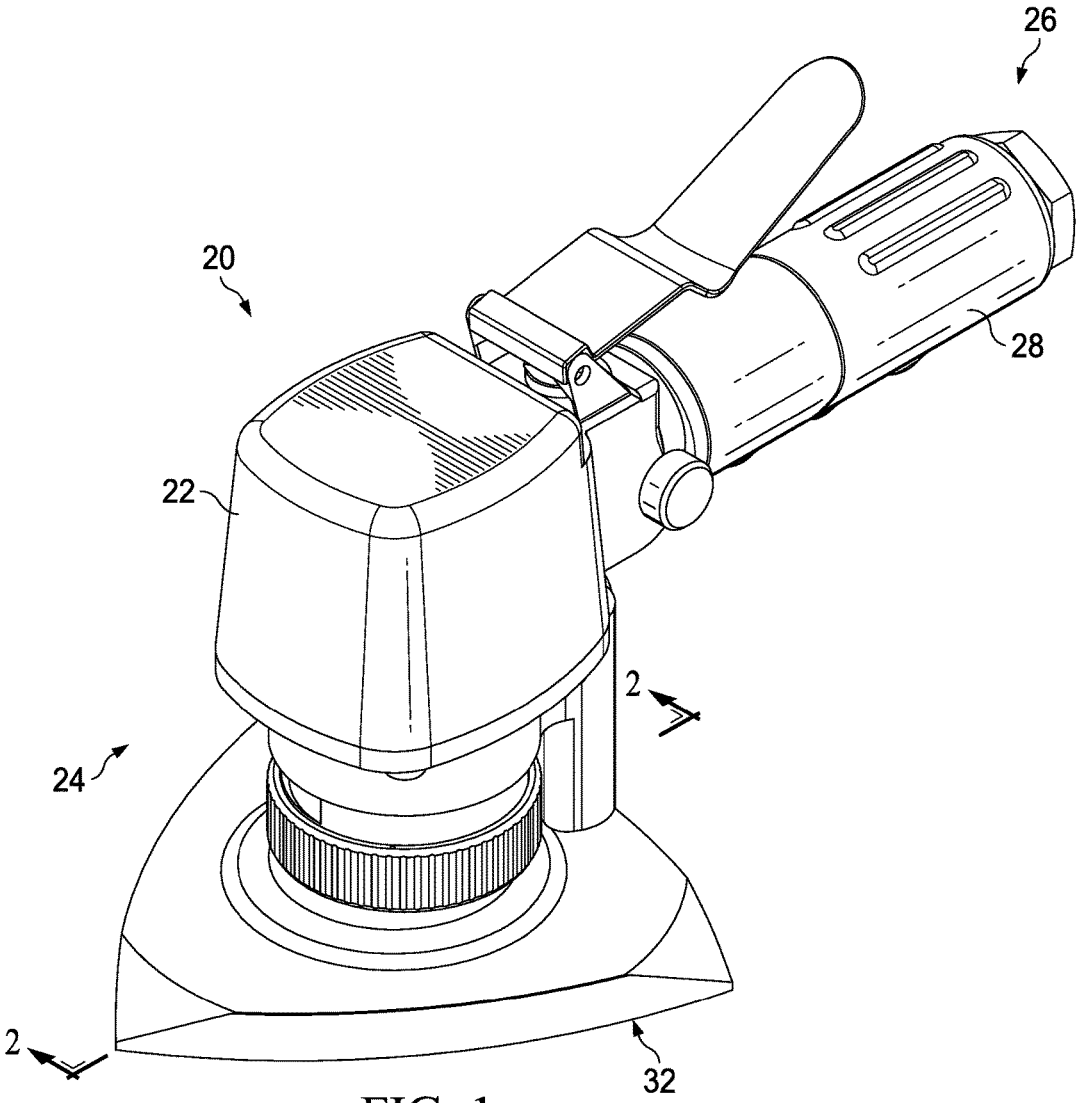
FIG. 1 is a front isometric view depicting a handheld sander in association with a sanding pad, in accordance with one embodiment.
Figure 2:
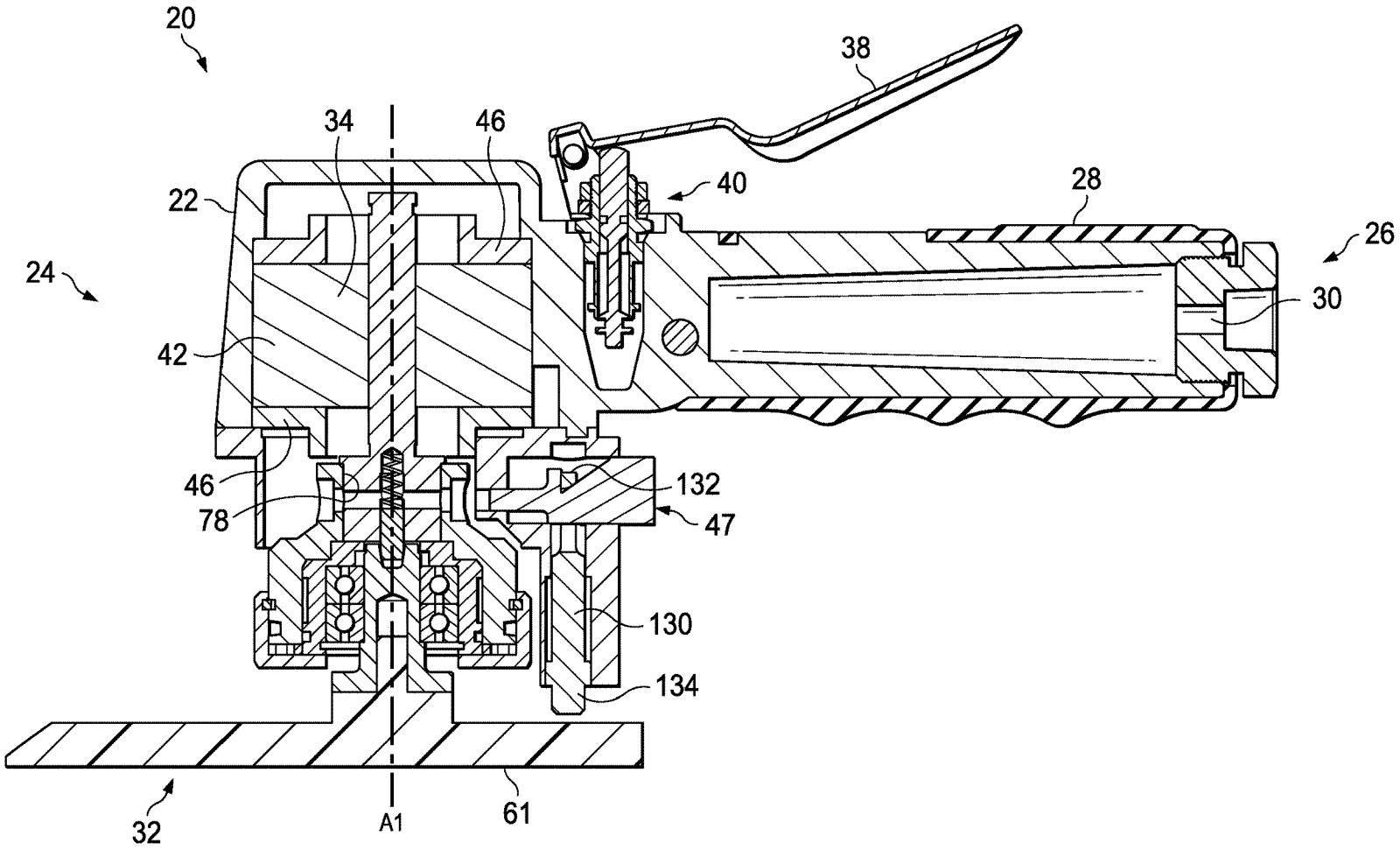
FIG. 2 is a cross-sectional view taken along the line 2-2 in FIG. 1.

Embodiments are hereinafter described in detail in connection with the views and examples of FIGS. 1-22, wherein like numbers indicate the same or corresponding elements throughout the views. According to one embodiment, as illustrated in FIGS. 1 and 2, a handheld sander 20 is provided that allows for selection from among a rotary sanding mode, a random orbital sanding mode, and an orbital sanding mode. The handheld sander 20 can include a housing 22 that extends between a front end 24 and a rear end 26. The housing 22 can include a hollow handgrip 28. An air supply port 30 can be disposed at a bottom of the hollow handgrip 28 and can be fluidly coupled with an air compressor (not shown) or another external source of pressurized air or other fluid. The pressurized air provided into the air supply port 30 can facilitate selective powering of the handheld sander 20 to actuate a sanding pad 32 for sanding an underlying surface (not shown). Although the handheld sander 20 is shown and described herein as being powered pneumatically, other suitable alternatively powered arrangements are contemplated, such as an electrically powered hand sander.

Figure 3:
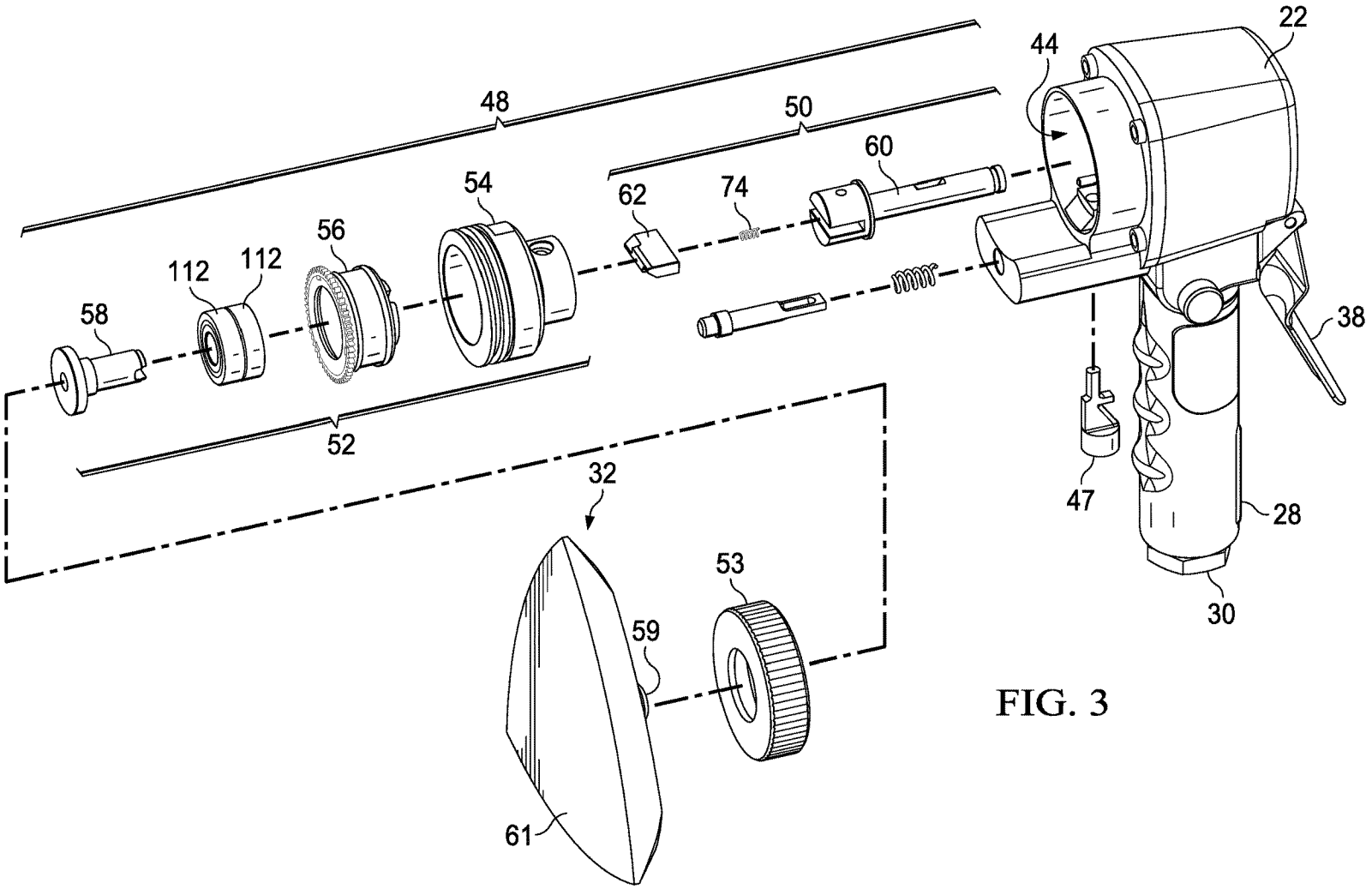
FIG. 3 is an exploded front isometric view depicting the handheld sander of FIG. 1.

As illustrated in FIGS. 2 and 3, the handheld sander 20 can include a rotary motor 34, such as a rotary vane motor, for example. The rotary motor 34 can be in selective fluid communication with the air supply port 30 and can be selectively powered with pressurized air from the air supply port 30. The handheld sander 20 can include a trigger 38 that is secured to the hollow handgrip 28. The trigger 38 can be selectively actuated to facilitate operation of the rotary motor 34. The trigger 38 can be associated with a trigger valve assembly 40 (FIG. 2) that is disposed within the hollow handgrip 28. The trigger valve assembly 40 can be selectively actuated by the trigger 38 to facilitate communication of pressurized air to the rotary motor 34. The hollow handgrip 28 can be configured to conform to a user's hand when grasping the hollow handgrip 28 (e.g., to operate the trigger 38).

The rotary motor 34 can include a rotor 42 that is at least partially disposed within a motor compartment 44 (FIG. 3) defined by the housing 22. The rotor 42 can be rotatable with respect to the housing 22 about a drive axis A1 (FIG. 2). The rotor 42 can be sandwiched between a pair of bushings 46 (FIG. 2) that rotationally supports the rotor 42 within the motor compartment 44. The rotor 42 can be configured to rotate in either a clockwise direction or a counterclockwise direction (e.g., when viewing the handheld sander 20 from the rear end 26). In one embodiment, the rotary motor 34 can be unidirectional such that the rotor 42 rotates in only one of a clockwise direction or a counterclockwise direction. In another embodiment, the rotary motor 34 can be reversible and can include a selection switch (not shown) to allow a user to select rotation of the rotor 42 to rotate in either a clockwise or counterclockwise direction. As illustrated in FIG. 3, a lock button 47 can be slidably coupled with the housing 22 and can be selectively depressed to lock the rotary motor 34 in place to allow for selective removal and installation of the sanding pad 32 from the rotary motor 34.

Referring now to FIG. 3, the handheld sander 20 can include a drive assembly 48 that includes a driveshaft 50, a hub assembly 52, and a selection collar 53. The hub assembly 52 can include an outer hub 54, an inner hub 56 and a stem 58. The driveshaft 50 can be operably coupled with each of the rotary motor 34 and the hub assembly 52, and the hub assembly 52 can be operably coupled with the sanding pad 32 to facilitate actuation of the sanding pad 32 by the rotary motor 34. In particular, the sanding pad 32 can include a mounting stem 59 that can be releasably coupled with the stem 58 of the hub assembly 52 such that the sanding pad 32 is rotatable together with the stem 58. The selection collar 53 can be operably coupled with the hub assembly 52 and can facilitate selection between the rotary sanding mode and one of the random orbital mode and the orbital mode.

Still referring to FIG. 3, the sanding pad 32 can include a lower surface 61, and a sanding substrate (not shown), such as sand paper, can be attached to the lower surface 61 via a hook and loop fastener arrangement, adhesive, or any of a variety of other suitable alternative attachment arrangements. It is to be appreciated that other surface treatment substrates can be releasably attached on the lower surface 61, such as a buffing pad, for example. It is also to be appreciated that although the sanding pad 32 is shown to be substantially triangularly shaped, any of a variety of sanding pad shapes can be utilized, such as, for example, a round pad shape.

Figure 4:
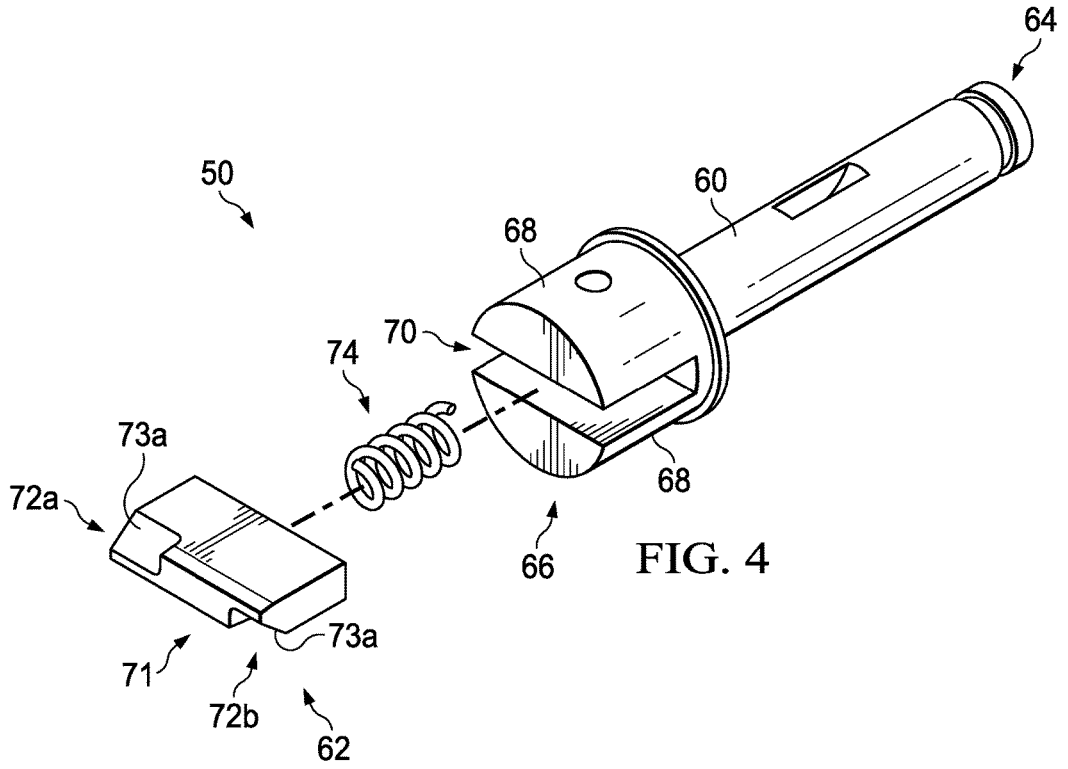
FIG. 4 is an exploded front isometric view depicting a driveshaft of the handheld sander of FIGS. 1-3, wherein a front cap has been removed for clarity of illustration.
Figure 17:
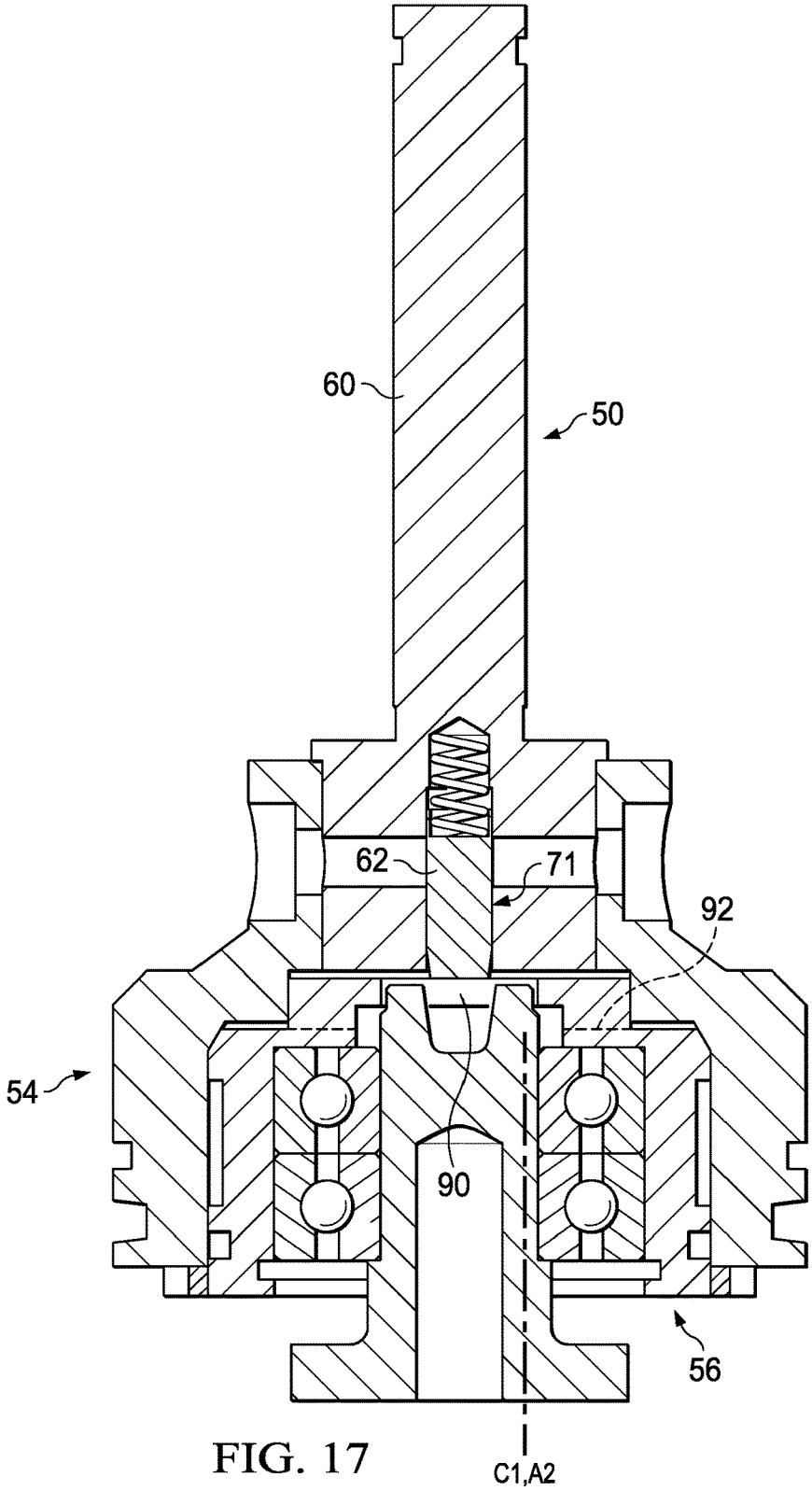
FIG. 17 is similar to FIG. 14 but with the inner hub shown in a second position and the tip portion shown in a retracted position.

Referring now to FIG. 4, the driveshaft 50 can include a drive member 60 and a tip portion 62. The drive member 60 can include a proximal end 64 and a distal end 66. The proximal end 64 can be coupled with the rotary motor 34 to facilitate rotation of the driveshaft 50 about the drive axis A1. The distal end 66 of the drive member 60 can include a pair of tab members 68 that are spaced from each other and define a slot 70. The tip portion 62 can be disposed in the slot 70 such that the tip portion 62 is slidably coupled with the distal end 66 of the drive member 60 and slidable between an extended position (FIG. 14) and a retracted position (FIG. 17). The tip portion 62 can include a distal end 71 that comprises a pair of tapered outer edge portions 72*a*, 72*b* that each have a sloped surface 73*a*, 73*b* that is angled substantially opposite to the other sloped surface 73*a*, 73*b* (e.g., the sloped surface 73*a* has an angle of 20 degrees and the sloped surface 73*b* has an angle of −20 degrees relative to each other). The tip portion 62 can be biased into the extended position by a spring 74 or any of a variety of other suitable biasing arrangements.

Figure 5:
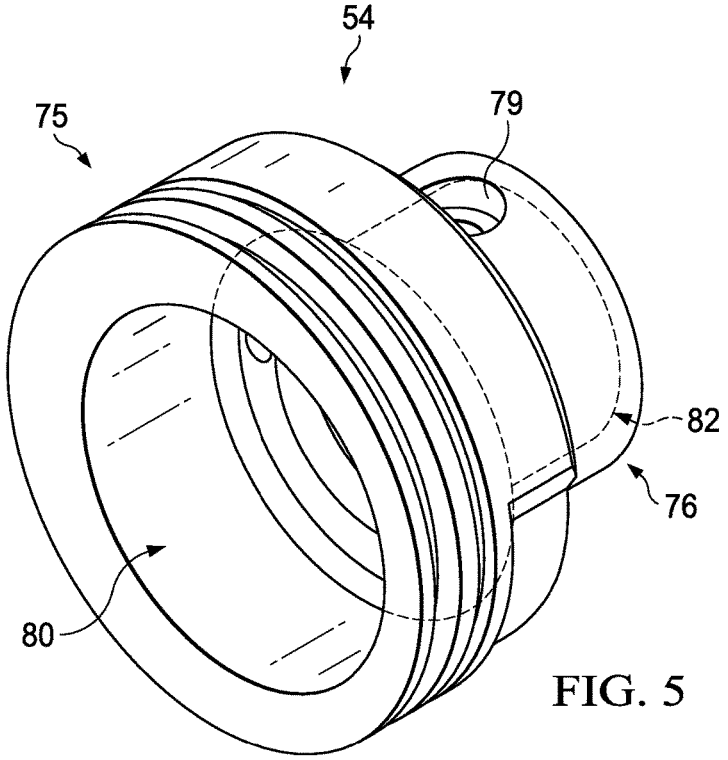
FIG. 5 is a front isometric view depicting an outer hub of a hub assembly of the handheld sander of FIGS. 1-3.
Figure 6:
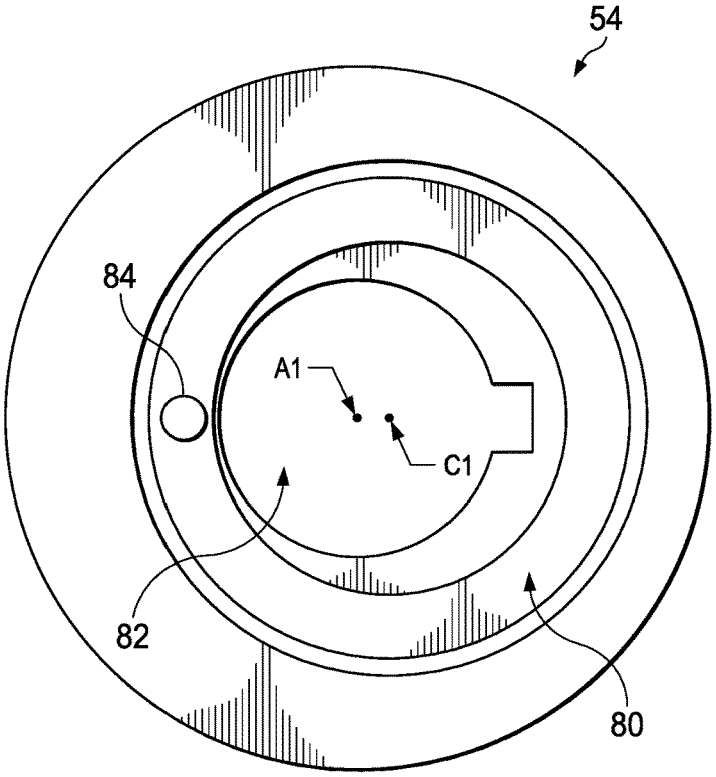
FIG. 6 is a front elevational view depicting the outer hub of FIG. 5.

The driveshaft 50 can be engaged with the outer hub 54 such that the driveshaft 50 and the outer hub 54 rotate together about the drive axis A1. Referring now to FIGS. 5 and 6, the outer hub 54 can comprise a main body 75 and a collar 76 that extends from the main body 75 and facilitates coupling of the driveshaft 50 with the outer hub 54. In one embodiment, the collar 76 can define a through hole 79 (FIG. 5) that is configured to receive a threaded plug (not shown) that engages the drive member 60 when the drive member 60 is inserted in the collar 76. In other embodiments, the drive member 60 can be secured to the outer hub 54, via the collar 76 or other arrangements, through welding, with adhesive, or with any of a variety of suitable alternative joining methods. The collar 76 can also include a stop hole 78 (FIGS. 2 and 13) into which the lock button 47 can extend when depressed to facilitate locking of the rotary motor 34 in place.

The main body 75 of the outer hub 54 can define a receptacle 80 that is configured to receive the inner hub 56 as will be described in further detail below. As illustrated in FIG. 6, the receptacle 80 can be substantially cylindrically shaped and can define a centerline C1 that extends through the geometric center of the receptacle 80 and is substantially parallel to the drive axis A1. The centerline C1 of the receptacle 80 can be offset from (e.g., spaced from) the drive axis A1 such that the receptacle 80 is eccentrically located on the main body 75. The main body 75 and the collar 76 can define a passageway 82 that extends through to the receptacle 80. A detent pin 84 can be disposed in the receptacle 80 and located adjacent to the passageway 82.

Figure 7:
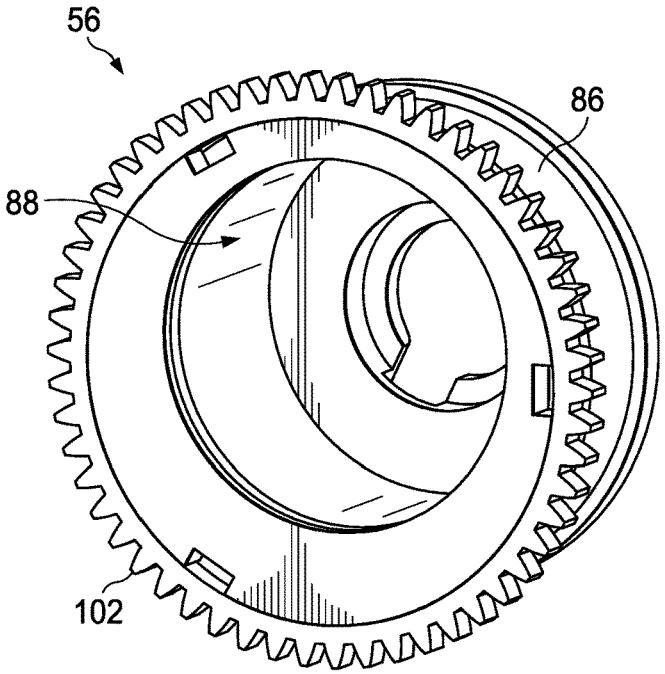
FIG. 7 is a front isometric view depicting an inner hub of a hub assembly of the handheld sander of FIGS. 1-3.
Figure 8:
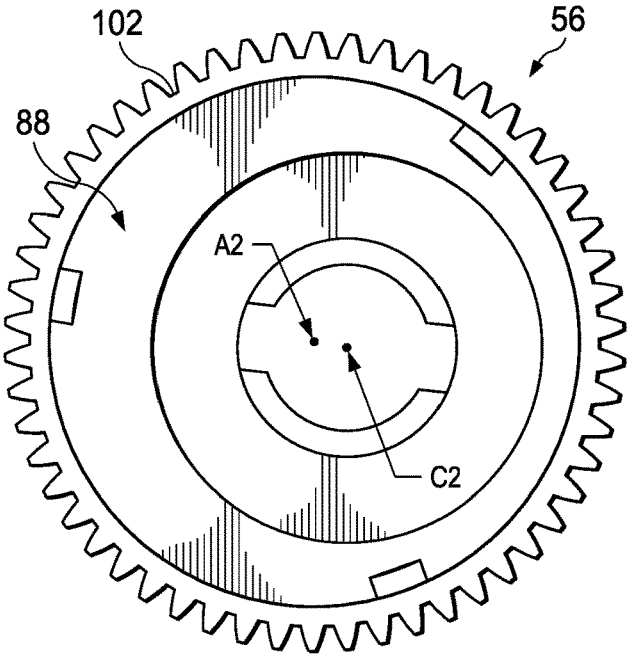
FIG. 8 is a front elevational view depicting the inner hub of FIG. 7.

Referring now to FIGS. 7-10, the inner hub 56 will now be described. As illustrated in FIGS. 7 and 8, the inner hub 56 can comprise a main body 86 that defines a receptacle 88 for receiving the stem 58 as will be described in further detail below. As illustrated in FIG. 8, the receptacle 88 can be substantially cylindrically shaped and can define a centerline C2 that extends through the geometric center of the receptacle 88 and is substantially parallel to the drive axis A1. The centerline C2 of the receptacle 88 can be offset from (e.g., spaced from) a central axis A2 of the inner hub 56 such that the receptacle 88 is eccentrically located on the main body 86.

Figure 9:
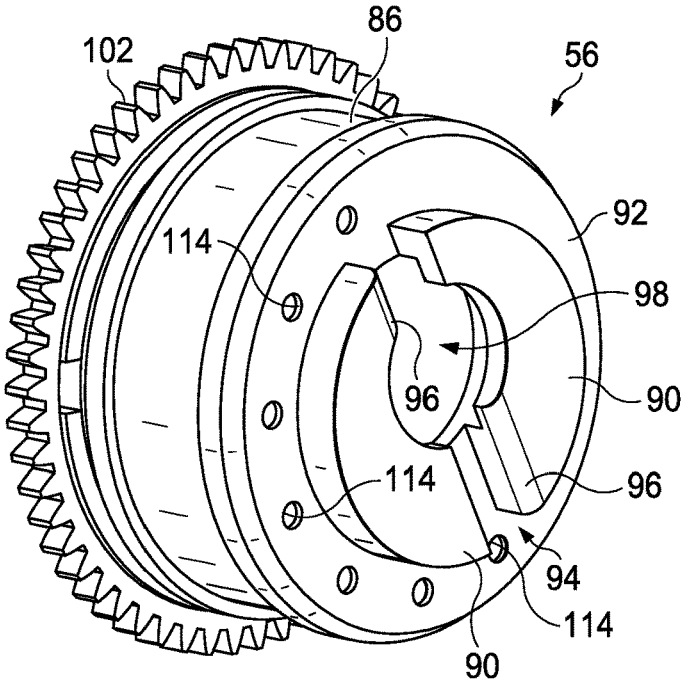
FIG. 9 is a rear isometric view depicting the inner hub of FIG. 7.
Figure 10:
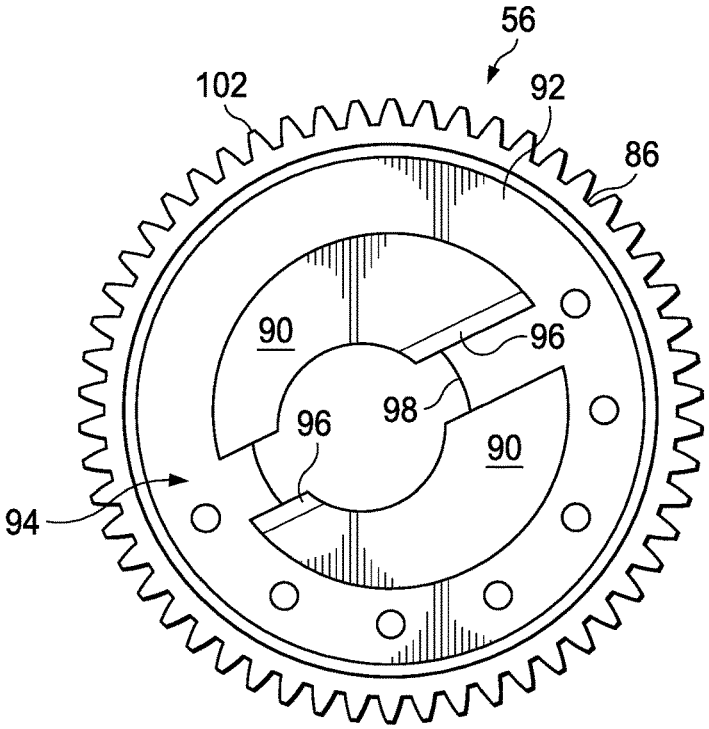
FIG. 10 is a rear elevational view depicting the inner hub of FIG. 7.

As illustrated in FIGS. 9 and 10, the inner hub 56 comprises a pair of shoulders 90 that are disposed along an upper surface 92 of the main body 86. The shoulders 90 are spaced from one another and define a slot 94. Each of the shoulders 90 has a chamfered edge 96 located at the slot 94. The upper surface 92 of the main body 86 can define an opening 98 beneath the slot 94 that extends to the receptacle 88.

As illustrated in FIGS. 7-10, the inner hub 56 can comprise an inner gear ring 102 that is disposed circumferentially about the main body 86. The inner gear ring 102 can be secured to the main body 86 through press fitting, welding, or any of a variety of other suitable alternative attachment methods.

Figure 11:
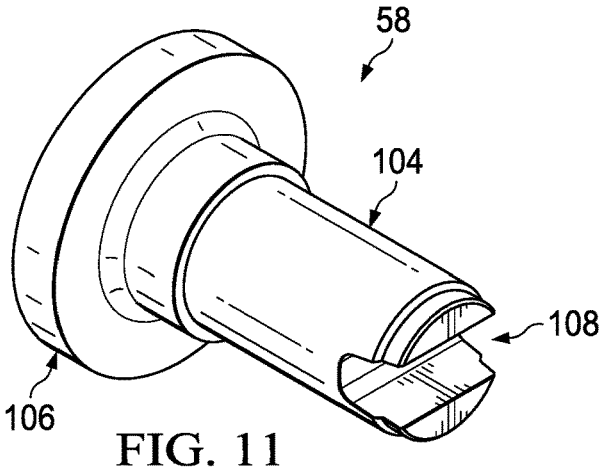
FIG. 11 is a rear isometric view depicting a stem of the hub assembly of the handheld sander of FIGS. 1-3.
Figure 12:
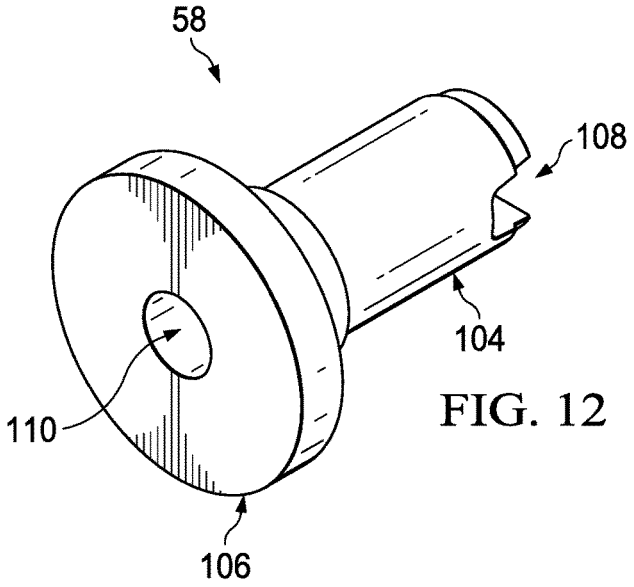
FIG. 12 is a front isometric view depicting the stem of FIG. 11.

Referring now to FIGS. 11 and 12, the stem 58 can include a shaft 104 and a base portion 106 coupled with the shaft 104. As illustrated in FIG. 11, the stem 58 can define a slot 108. As illustrated in FIG. 12, the base portion 106 can define a mount hole 110 that is configured to receive the mounting stem 59 of the sanding pad 32 to facilitate coupling of the sanding pad 32 to the stem 58. In one embodiment, the mounting stem 59 can comprise a threaded stem and the mount hole 110 can comprise internal threads that facilitate threaded coupling of the sanding pad 32 with the stem 58. In other embodiments, the mounting stem 59 can be releasably coupled with the stem 58 via a bayonet connection, or any of a variety of suitable alternative arrangements.

Figure 13:
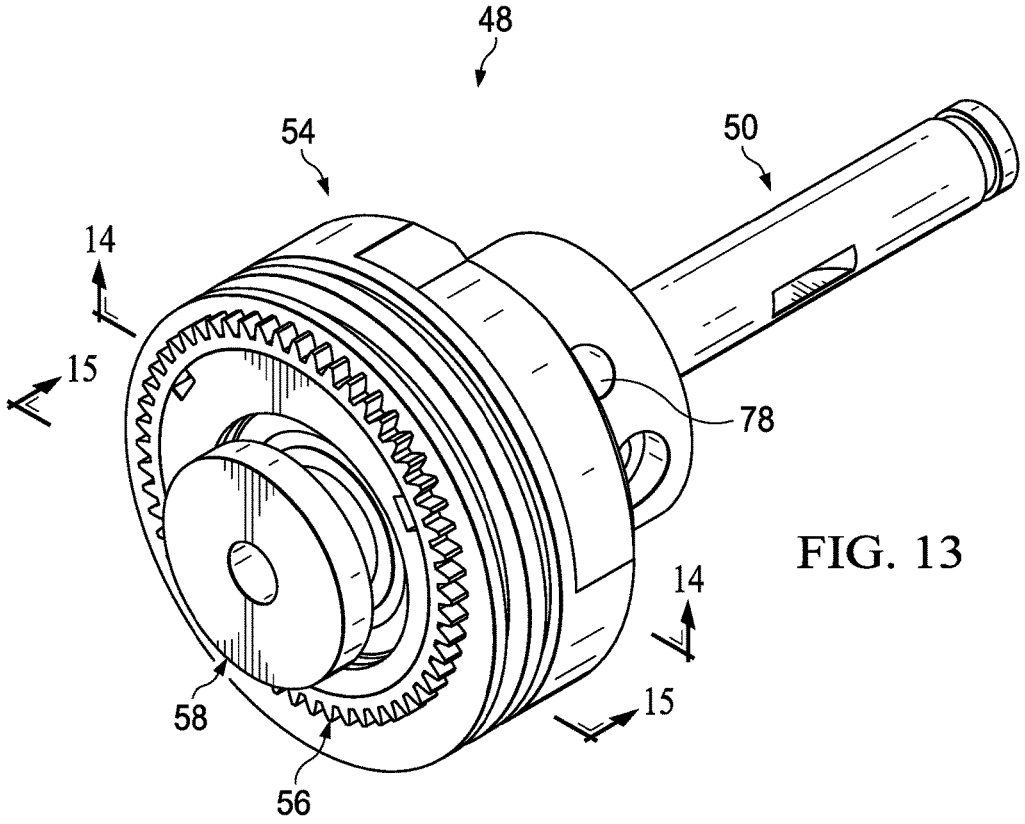
FIG. 13 is a front isometric view depicting a drive assembly of the handheld sander of FIGS. 1-3.
Figure 14:
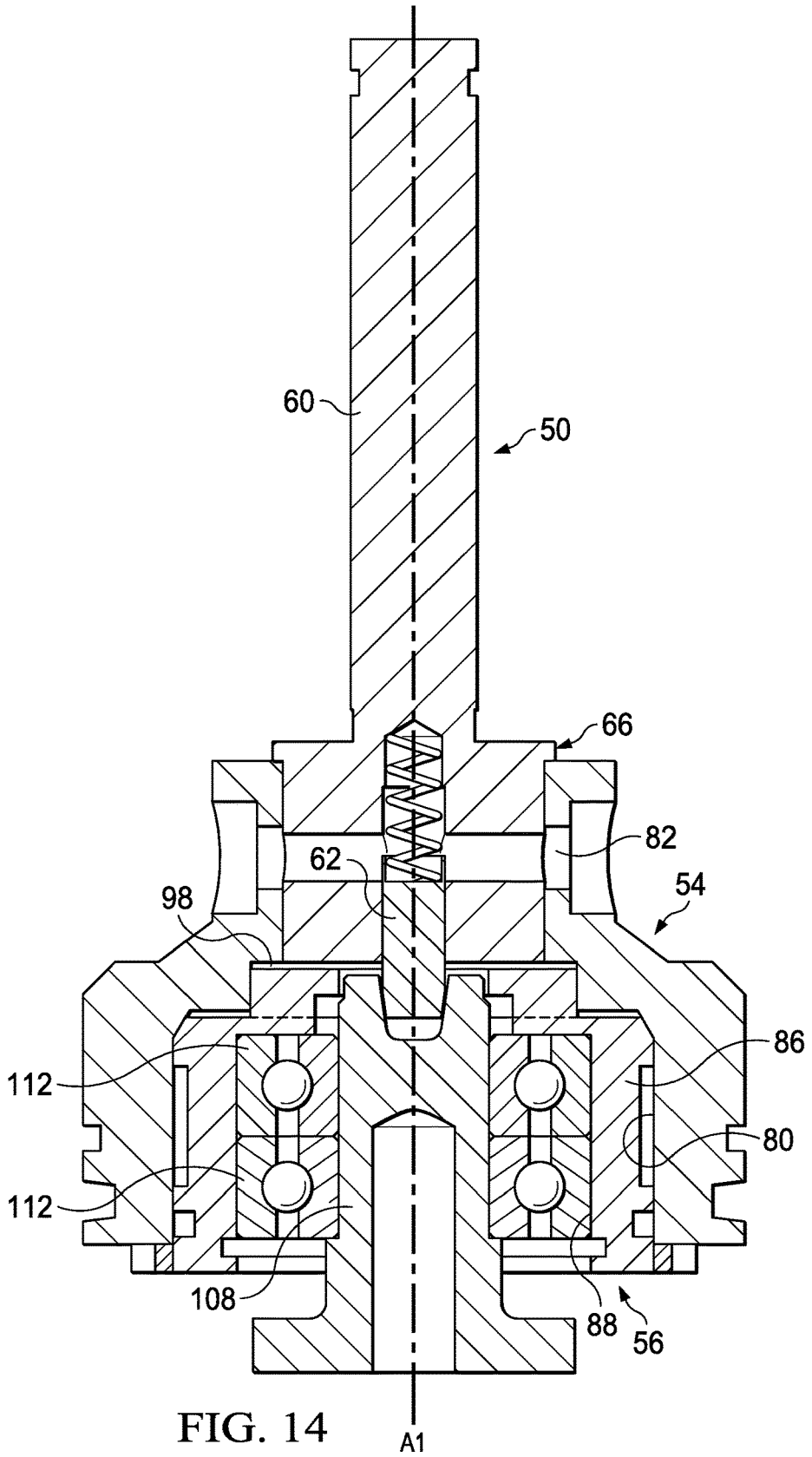
FIG. 14 is a cross-sectional view taken along the line 14-14 in FIG. 13 with an inner hub shown in a first position and a tip portion shown in an extended position.

Referring now to FIGS. 13-16, an assembled view of the drive assembly 48 is illustrated and will now be described. As illustrated in FIGS. 13 and 14, the main body 86 of the inner hub 56 can be at least partially disposed in the receptacle 80 of the outer hub 54 and rotatably coupled with the outer hub 54 such that the central axis A2 of the inner hub 56 is coaxial with the centerline C1 of the receptacle 80 of the outer hub 54 (FIG. 17). In one embodiment, the inner hub 56 can be rotatably coupled to the outer hub 54 with circlips (not shown), however, any of a variety of other suitable rotatable coupling arrangements are contemplated.

As illustrated in FIG. 14, the shaft 104 of the stem 58 can extend through the receptacle 88 of the inner hub 56 and into the opening 98. A pair of bearings 112 can journal the shaft 104 of the stem 58 relative to the inner hub 56 such that the stem 58 is rotatably coupled with the inner hub 56 and is rotatable about the centerline C2 (FIG. 17) of the receptacle 88 of the inner hub 56. The distal end 66 of the drive member 60 can extend through the passageway 82 to the inner hub 56 such that the tab members 68 of the drive member 60 abut the inner hub 56. The tip portion 62 can accordingly extend through the opening 98 and into selective engagement with the stem 58.

Movement of the tip portion 62 between the extended position and the retracted position can facilitate selective coupling of the driveshaft 50 with the stem 58. For example, when the tip portion 62 is in the extended position, the distal end 71 of the tip portion 62 can extend into the slot 108 such that the driveshaft 50 and the stem 58 are operably coupled together. When the rotary motor 34 is actuated, the driveshaft 50 can rotate the stem 58 which can facilitate operation of the handheld sander 20 in a rotary sander mode, as will be described in further detail below. When the tip portion 62 is in the retracted position, the distal end 71 of the tip portion 62 can be retracted from the slot 108 of the stem 58 such that the driveshaft 50 is decoupled from the stem 58. When the rotary motor 34 is actuated with the tip portion 62 disengaged from the stem 58, the driveshaft 50 can rotate the outer hub 54 and the stem 58 is permitted to rotate freely with respect to the outer hub 54 which can facilitate operation of the handheld sander 20 in an orbital sanding mode, as will be described in further detail below.

Figure 15:
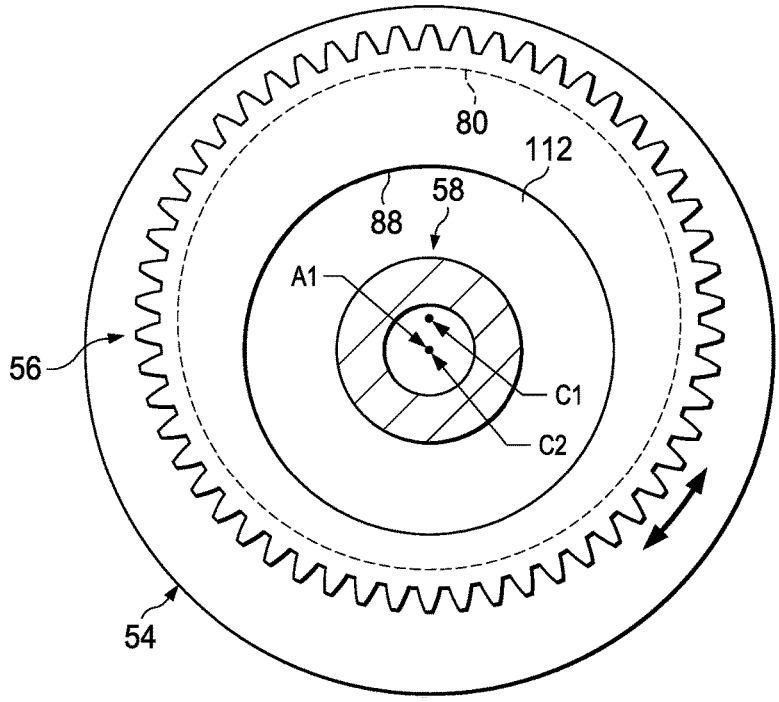
FIG. 15 is a cross-sectional view taken along the line 15-15 in FIG. 13 with the inner hub shown in the first position.
Figure 16:
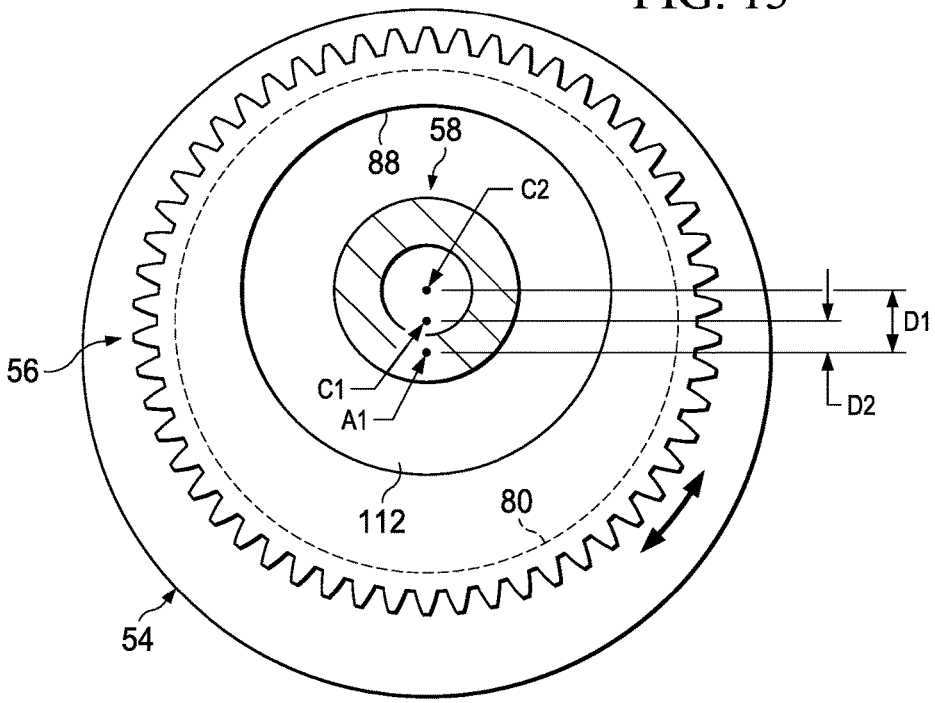
FIG. 16 is similar to FIG. 15 but with the inner hub shown in a second position.

As illustrated in FIGS. 15-17, the inner hub 56 can be rotatable with respect to the outer hub 54 between a first position (FIG. 15) and a second position (FIG. 16). Rotation of the inner hub 56 between the first position and the second position can facilitate sliding of the tip portion 62 between the extended position and the retracted position. For example, when the inner hub 56 is in the first position, as illustrated in FIG. 15, the spring 74 urges the tip portion 62 into the extended position such that the distal end 71 of the tip portion 62 can extend into the slot 108 of the stem 58. In such an arrangement, the driveshaft 50 can be engaged with the stem 58 such that the stem 58 is rotated by the rotary motor 34 which facilitates operation of the handheld sander 20 in the rotary sanding mode.

When the inner hub 56 is rotated out of the first position and towards the second position, the sloped surfaces 73*a*, 73*b* of the tapered outer edge portions 72*a*, 72*b* of the tip portion 62 ride along the chamfered edges 96 of the shoulders 90 which urges the tip portion 62 towards the retracted position. As the tip portion 62 moves towards the retracted position, the distal end 71 is pulled out of the slot 108 of the stem 58 and comes to rest on top of the shoulders 90, as illustrated in FIG. 17. This disengages the stem 58 from the driveshaft 50 to facilitate operation of the handheld sander 20 in one of the random orbital sanding mode and the orbital sanding mode, as will be described in further detail below.

When the handheld sander 20 is in the random orbital sanding mode or the orbital sanding mode, the distal end 71 of the tip portion 62 can rest on top of the shoulders 90 such that it remains in the retracted position, while riding along the top of the shoulders 90 until the inner hub 56 is returned to the first position. When the inner hub 56 is returned to the first position (i.e., to place the handheld sander 20 in the rotary sanding mode), the spring 74 can urge the tip portion 62 into the extended position and into the slot 70 such that the distal end 71 of the tip portion 62 engages the stem 58.

When the inner hub 56 is in the first position, as illustrated in FIG. 15, the second centerline C2 can be coaxial with the drive axis A1 such that rotation of the driveshaft 50 facilitates rotation of the stem 58 without any orbital rotation. When the inner hub 56 is in the second position, as illustrated in FIG. 16, the second centerline C2 can be offset from the drive axis A1 by a distance d1 which can facilitate orbiting of the stem 58 about the drive axis A1. The distance d1 can be about twice as long as the distance d2 between the centerline C1 and the drive axis A1. The distance d1 can define the orbital diameter of the stem 58 which can be about twice the length of the distance d1. For example, a distance d1 of ½ inch can result in about a one inch orbital diameter for the stem 58.

It should be appreciated that providing the inner hub 56 in the first position simultaneously facilitates engagement between the driveshaft 50 and the stem 58, and aligns the rotational axis of the stem 58 (e.g., C2) with drive axis A1. As such, when the inner hub 56 is in the first position, the handheld sander 20 can be in the rotary sanding mode since power from the rotary motor 34 is being provided directly to the sanding pad 32 (via the driveshaft 50 and the stem 58) and the sanding pad 32 rotates along the drive axis A1 without any orbital action. It should also be appreciated that rotating the inner hub 56 out of the first position simultaneously facilitates disengagement of the stem 58 from the driveshaft 50, and offsets the rotational axis of the stem 58 (e.g., C2) from drive axis A1 such that the handheld sander 20 is switched from the rotary sander mode to one of the random orbital sanding mode and the orbital sanding mode, as will be described in further detail below.

The inner hub 56 can be selectively positionable between the first and second positions to facilitate selection of different orbital diameters for the stem 58. These orbital diameters can be less than the orbital diameter of the stem 58 when the inner hub 56 is in the second position. It is to be appreciated that rotating the inner hub 56 towards the first position can reduce the orbital diameter of the stem 58 and rotating the inner hub 56 towards the second position can increase the orbital diameter of the stem 58.

The outer hub 54 and the inner hub 56 can be configured to define a plurality of preset positions between the first position and the second position for the inner hub 56. In one embodiment, as illustrated in FIG. 9, the upper surface 92 of the inner hub 56 can define a plurality of indentations 114 that are distributed at least partially around the shoulders 90. When the inner hub 56 is rotated between the first position and the second position, the detent pin 84 (FIG. 6) of the outer hub 54 can register with the indentations 114 to retain the inner hub 56 in the positions defined by the indentations 114. In particular, as the inner hub 56 is rotated between the first position and the second position, the detent pin 84 can ride along the upper surface 92 of the inner hub 56. The detent pin 84 can be spring loaded such that each time the detent pin 84 reaches an indentation 114 it can automatically extend into the indentation 114 which can retain the inner hub 56 in its current position. Each time the detent pin 84 extends into an indentation 114, the inner hub 56 can be moved to the next position by rotating the inner hub 56 with enough force to overcome the interaction between the detent pin 84 and the indentation 114. In one embodiment, each of the indentations 114 can represent a 1/16 inch different in the distance between the centerline C2 and the drive axis A1 (e.g., a ⅛ inch difference in the rotational orbit). It is to be appreciated that any quantity of indentations (e.g., 114) can be provided along the upper surface 92 at any of a variety of different locations for achieving desired orbital patterns. It will also be appreciated that any of a variety of suitable alternative retention arrangements can be provided that define a plurality preset positions for the inner hub 56.

Figure 18:
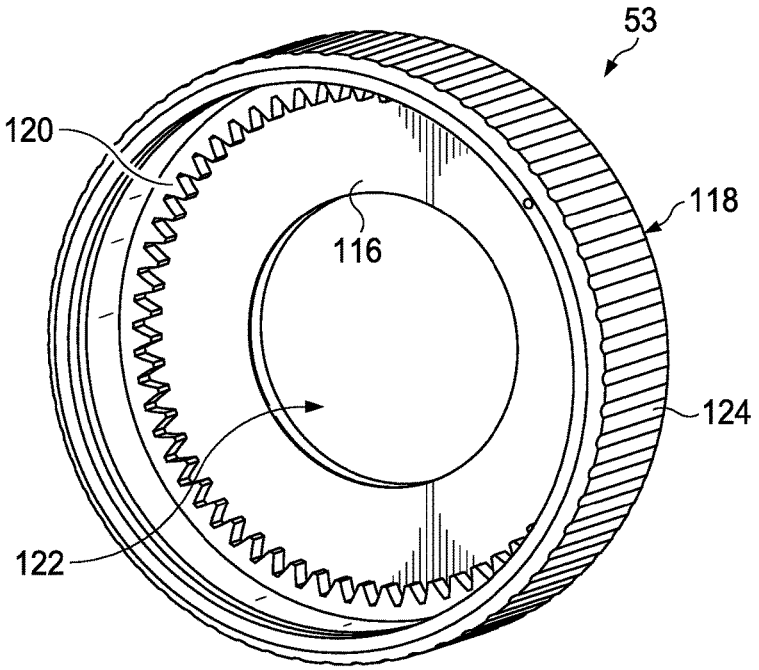
FIG. 18 is a rear isometric view depicting a selection collar of the handheld sander of FIGS. 1-3.

Referring now to FIGS. 2, 3 and 18, the selection collar 53 can be operably coupled with the inner hub 56 and can be configured to facilitate manual rotation of the inner hub 56 between the first and second positions. As illustrated in FIG. 18, the selection collar 53 can include a plate 116 and a grip portion 118 that extends from the plate 116. The selection collar 53 can also include an outer gear ring 120 that is disposed circumferentially about the plate 116. The plate 116 can define an opening 122. As illustrated in FIG. 3, when the selection collar 53 is positioned on the inner hub 56, the stem 58 can extend through the opening 122 and the outer gear ring 120 can be intermeshed with the inner gear ring 102 of the inner hub 56 such that the inner hub 56 and the selection collar 53 are coupled together. The grip portion 118 can include a grip surface 124 that is configured to facilitate manual grasping of the selection collar 53. In one embodiment, the grip surface 124 can be formed of an elastomeric material that is configured to conform to a user's hand when grasping the selection collar 53. The grip portion 118 can surround the hub assembly 52 and can be disposed between the housing 22 and the sanding pad 32 such that the grip portion 118 can be accessible to a user's hand to enable manual positioning of the inner hub 56 relative to the outer hub 54.

The method for transitioning between the rotary sanding mode and the random orbital mode for the handheld sander 20, as well as the operation of the handheld sander 20 in rotary sanding mode and the random orbital mode, will now be discussed starting with the rotary sanding mode. When the handheld sander 20 is in the rotary sanding mode, the inner hub 56 can be in the first position. The tip portion 62 of the driveshaft 50 can be in the extended position and engaged with the slot 108 of the stem 58 such that the driveshaft 50 and the stem 58 are engaged with each other. When the user actuates the trigger 38, the rotary motor 34 can rotate the driveshaft 50 and the stem 58 together about the drive axis A1.

To transition the handheld sander 20 from the rotary sanding mode to the random orbital mode, the inner hub 56 can be rotated out of the first position using the selection collar 53 and the position of the inner hub 56 can be selected with the selection collar 53 to achieve a desired orbital diameter. When the inner hub 56 is rotated out of the first position, the inner hub 56 is rotated with respect to the tip portion 62 of the driveshaft 50. This rotation can cause the sloped surfaces 73*a*, 73*b* of the tapered outer edge portions 72*a*, 72*b* of the tip portion 62 to engage the chamfered edges 96 of the shoulders 90 which interacts with the sloped surfaces 73*a*, 73*b* to urge the tip portion 62 into the retracted position such that the distal end 71 is withdrawn from the slot 108 of the stem 58. The distal end 71 of the tip portion 62 can rest on top of the shoulders 90. When the user actuates the trigger 38, the rotary motor 34 can rotate the driveshaft 50, the outer hub 54 and the inner hub 56 together. The stem 58 can orbit about the drive axis Al and the centrifugal motion from the outer and inner hubs 54, 56 can be imparted to the stem 58 to cause the sanding pad 32 to rotate as well.

To transition the handheld sander 20 from the random orbital mode to the rotary sanding mode, the inner hub 56 can be rotated into the first position using the selection collar 53. When the inner hub 56 is rotated into the first position, the tip portion 62 of the driveshaft 50 can be aligned with the slot 94 of the inner hub 56 such that the tip portion 62 automatically extends to the extended position (through biasing of the spring 74) and into engagement with the slot 108 of the stem 58.

Figure 19:
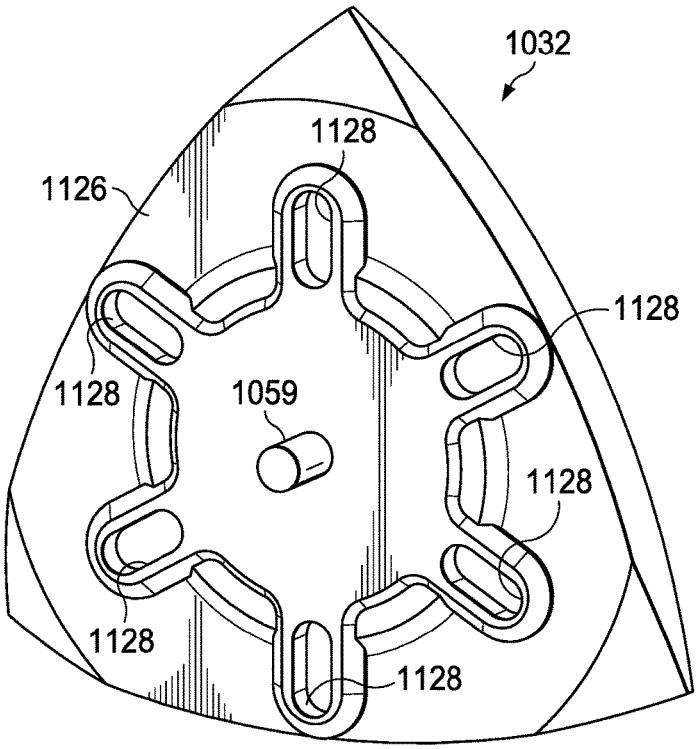
FIG. 19 is a rear isometric view depicting a sanding pad, in accordance with an alternative embodiment.

Referring now to FIG. 19, an alternative embodiment of a sanding pad 1032 is illustrated that can replace the sanding pad 32 shown in FIGS. 1-3 to facilitate operation of the handheld sander 20 in the orbital sanding mode. The sanding pad 1032 can include an upper surface 1126 and a mounting stem 1059 located at the upper surface 1126. The upper surface 1126 can define a plurality of slotted recesses 1128 that extend radially with respect to the mounting stem 1059.

Figure 20:
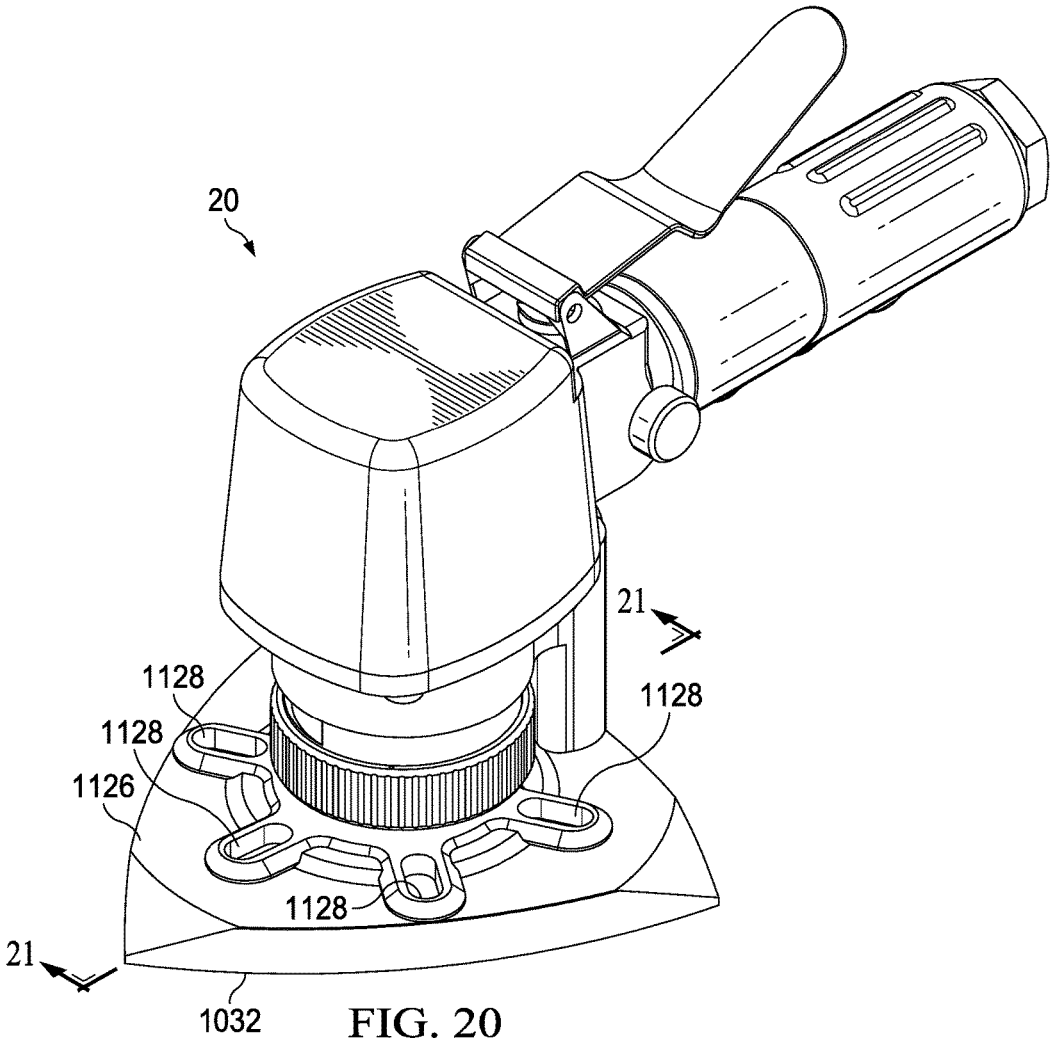
FIG. 20 is a front isometric view depicting the handheld sander of FIGS. 1-3 in association with the sanding pad of FIG. 19.
Figure 21:
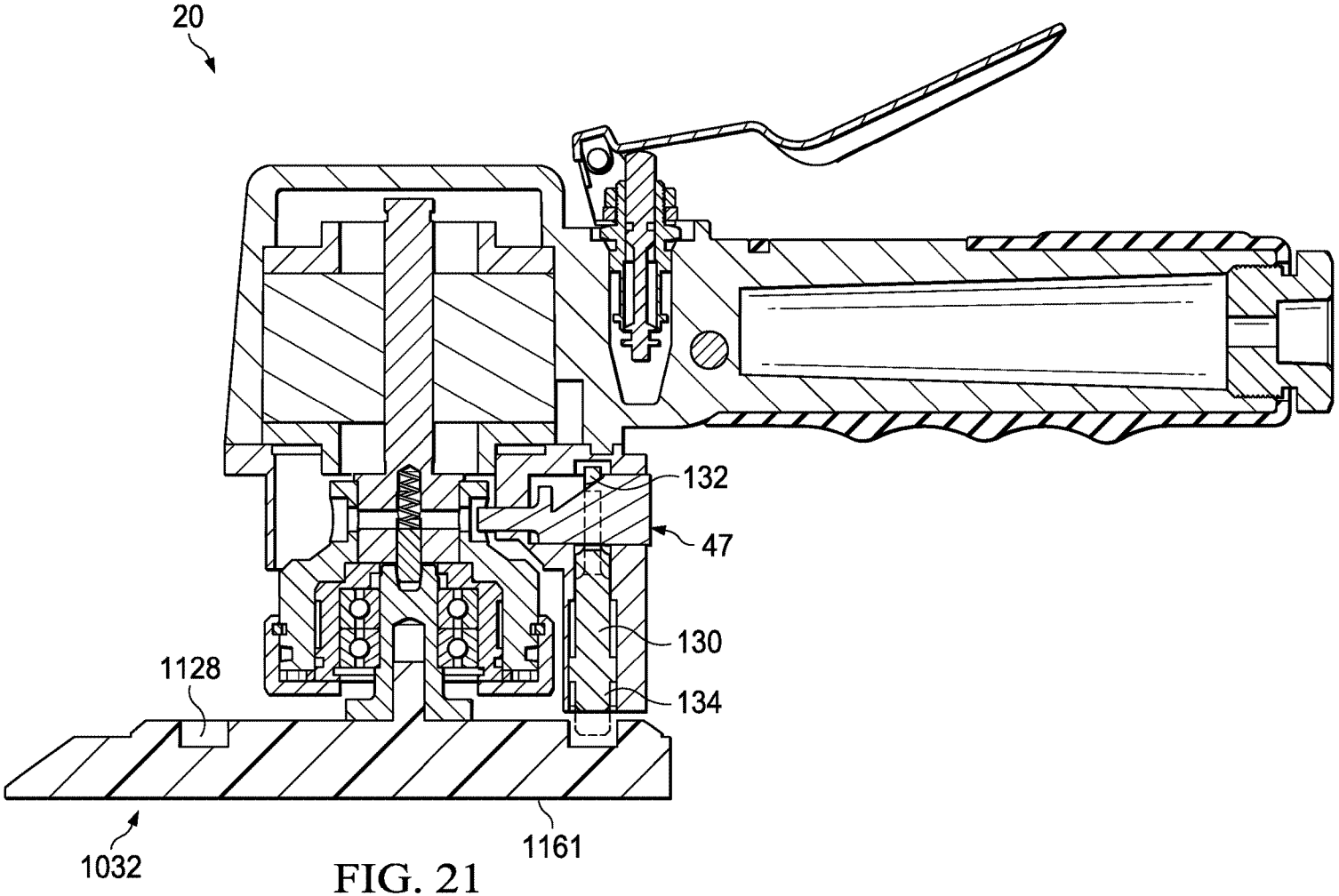
FIG. 21 is a cross-sectional view taken along the line 2-2 in FIG. 1.

Referring now to FIGS. 20 and 21, the sanding pad 1032 is shown to be installed on the handheld sander 20 in place of the sanding pad 32 illustrated in FIGS. 2 and 3. As illustrated in FIG. 21, the handheld sander 20 can include a plunger 130 that is slidably coupled with the housing 22 and is slidable between a retracted position (shown in solid lines) and an extended position (shown in dashed lines) to facilitate selective engagement of the plunger 130 with the sanding pad 1032. The plunger 130 can be biased into the extended position by a spring (131 in FIG. 3). The plunger 130 can include a proximal end 132 and a distal end 134. When the plunger 130 is in the extended position, the distal end 134 of the plunger 130 can be inserted into one of the slotted recesses 1128. The slotted recesses 1128 can be substantially ovular shaped (FIG. 19) such that interaction with the plunger 130 can prevent the sanding pad 1032 from rotating but facilitates orbiting of the sanding pad 1032. In particular, when the rotary motor 34 is operated, the distal end 134 of the plunger 130 can oscillate within the slotted recess 1128 which can facilitate orbiting of the sanding pad 1032 without rotation.

Figure 22:
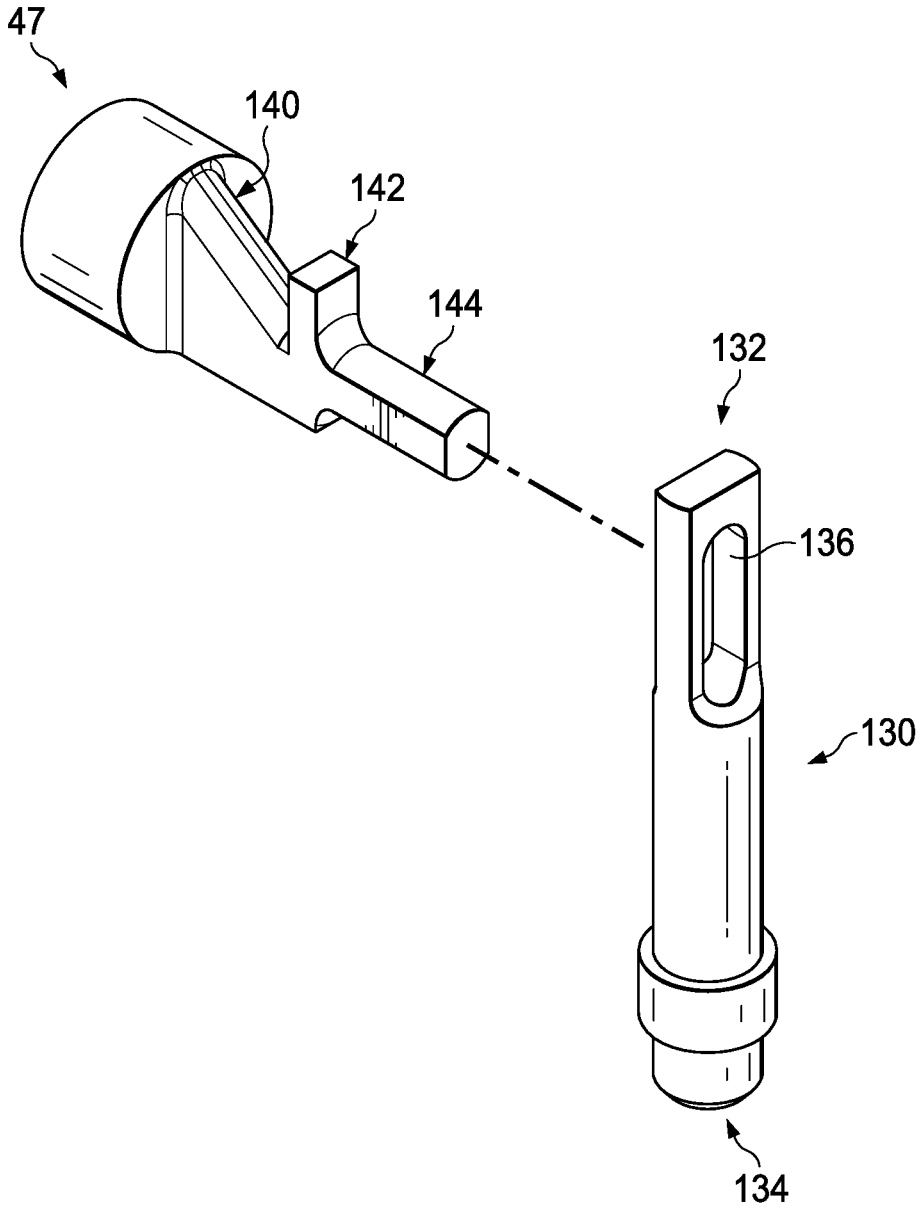
FIG. 22 is an exploded front isometric view depicting the handheld sander of FIG. 1.

In one embodiment, the lock button 47 (FIG. 3) can facilitate sliding of the plunger 130 between the retracted position and the extended position. Referring now to FIG. 22, the proximal end 132 of the plunger 130 can define a slotted aperture 136. The lock button 47 can include a sloped portion 140, a stop portion 142 and a stop pin 144. The stop portion 142 can be sandwiched between the sloped portion 140 and the stop pin 144. When the lock button 47 is disposed in the housing 22, as illustrated in FIG. 21, the lock button 47 can extend through the slotted aperture 136 of the plunger 130 such that the proximal end 132 can ride along the sloped portion 140. When the lock button 47 is not depressed, the proximal end 132 of the plunger 130 can rest against the stop portion 142 at the bottom of the sloped portion 140 such that the plunger 130 is in the extended position. When the lock button 47 is depressed and moved towards the rotary motor 34, the proximal end 132 of the plunger 130 can interact with the sloped portion 140 to ride upwardly along the sloped portion 140 such that the plunger 130 is pulled into the retracted position. The stop pin 144 can simultaneously be inserted into the stop hole 78 of the outer hub 54 to facilitate stopping of the rotary motor 34. As such, the distal end 134 of the plunger 130 can be pulled out of the slotted recesses 1128 of the sanding pad 1032 and the rotary motor 34 can be held in position, which can allow the sanding pad 1032 to be rotated and removed from the handheld sander 20. When the lock button 47 is released, the spring 131 can urge the plunger 130 into the extended position which can cause the proximal end 132 of the plunger 130 to ride downwardly along the sloped portion 140 which can push the lock button 47 into the undepressed (i.e., extended) position and pull the stop pin 144 away from the stop hole 78 of the outer hub 54.

Operation of the handheld sander 20 in the orbital sanding mode can accordingly be achieved by depressing the lock button 47 to pull the plunger 130 into the retracted position and lock the rotary motor 34 and installing the sanding pad 1032 onto the stem 58 of the handheld sander 20. The position of the sanding pad 1032 can then be manually adjusted to align one of the slotted recesses 1128 with the plunger 130 and then the lock button 47 can be released to allow the distal end 134 of the plunger 130 to extend into one of the slotted recesses 1128. The inner hub 56 can be rotated out of the first position using the selection collar 53 if the inner hub 56 is not in the first position (i.e., due to previous use of the handheld sander 20 in the rotary sanding mode), and the position of the inner hub 56 with respect to the outer hub 54 can be selected with the selection collar 53 to achieve a desired orbital diameter.

When the handheld sander 20 is in the orbital sanding mode, the configuration of the sanding pad 1032 can prevent operation of the handheld sander 20 in either the rotary sanding mode or the random orbital mode since the plunger 130 would likely interfere with the rotation of the sanding pad 1032. As such, transitioning from the orbital sanding mode to either the rotary sanding mode or the random orbital sanding mode can be achieved by first depressing the lock button 47 to lock the rotary motor 34 and then removing the sanding pad 1032. The sanding pad 32 shown in FIGS. 1-3 can then be installed on the stem 58 and the lock button 47 can be released to unlock the rotary motor 34. As illustrated in FIGS. 2 and 3, when the lock button 47 is released such that the plunger 130 is in the extended position, the plunger 130 can remain spaced from the sanding pad 32 which allows for rotation of the sanding pad 32 when the handheld sander 20 is operated in either the rotary sanding mode or the random orbital sanding mode.

It is to be appreciated that although a handheld sander is described herein, any of a variety of rotary tools are contemplated. The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. In some embodiments, the drawings can be understood to be drawn to scale. The scope of the disclosure is, of course, not limited to the examples or embodiments set forth herein, but can be employed in any number of applications and equivalent devices by those of ordinary skill in the art. Rather it is hereby intended the scope of the disclosure be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A handheld multifunction rotary tool comprising:

a housing;

a rotary motor disposed at least partially within the housing and rotatable with respect to the housing about a drive axis;

a driveshaft operably coupled with the rotary motor and comprising a drive member and a tip portion slidably coupled with the drive member, the tip portion being slidable with respect to the drive member between a retracted position and an extended position;

a stem rotatably coupled with the driveshaft and rotatable with respect to the driveshaft;

wherein:

the stem is configured to receive a surface treatment device;

when the tip portion of the driveshaft is in the retracted position, the tip portion is disengaged from the stem such that the stem is free to rotate with respect to the driveshaft; and when the tip portion of the driveshaft is in the extended position, the tip portion is engaged with the stem such that the stem rotates together with the driveshaft.

2. The handheld multifunction rotary tool of claim 1 wherein the tip portion is biased into the extended position.

3. The handheld multifunction rotary tool of claim 1 wherein the stem defines a slot for receiving the tip portion when the tip portion is in the extended position.

4. The handheld multifunction rotary tool of claim 1 further comprising:

an outer hub operably coupled with the driveshaft and configured to rotate together with the rotary motor and the driveshaft about the drive axis, the outer hub defining a first receptacle that defines a first centerline;

an inner hub disposed in the first receptacle and defining a second receptacle, the inner hub being rotatable with respect to the outer hub about the first centerline between a first position and a second position; wherein:

the stem is at least partially disposed in the second receptacle; and the driveshaft extends through a portion of each of the outer hub and the inner hub and into the second receptacle such that the stem is accessible to the tip portion to facilitate selective engagement between the tip portion and the stem.

5. The handheld multifunction rotary tool of claim 4 wherein:

the inner hub comprises a main body and a pair of shoulders disposed along an upper surface of the main body;

the pair of shoulders are spaced apart from each other and define a slot;

when the inner hub is in the first position, the tip portion is aligned with the slot such that the tip portion is in the extended position and is engaged with the stem; and when the inner hub is in the second position, the tip portion is misaligned with the slot and rests on the pair of shoulders such that the tip portion is in the retracted position and disengaged from the stem.

6. The handheld multifunction rotary tool of claim 5 wherein when the inner hub is moved from the first position to the second position, the pair of shoulders urges the tip portion out of the slot and into the retracted position.

7. The handheld multifunction rotary tool of claim 6 wherein at least one of the shoulders defines a chamfered edge and the tip portion defines a tapered edge that cooperate together to facilitate urging of the tip portion out of the slot and into the retracted position when the inner hub is moved from the first position to the second position.

8. The handheld multifunction rotary tool of claim 4 wherein:

the first centerline is offset from the drive axis;

the second receptacle of the inner hub defines a second centerline that is offset from the first centerline;

the stem is rotatable with respect to the inner hub about the second centerline;

when the inner hub is in the first position the second centerline is coaxial with the drive axis; and when the inner hub is in the second position, the second centerline is offset from the drive axis.

9. The handheld multifunction rotary tool of claim 8 further comprising a selection collar rotatably coupled with the outer hub and rotatable with respect to the outer hub about the drive axis, the selection collar being operably coupled with the inner hub and configured to facilitate selective rotational positioning of the inner hub between the first position and the second position.

10. The handheld multifunction rotary tool of claim 9 wherein the selection collar comprises an outer gear ring and the inner hub comprises an inner gear ring that is intermeshed with the outer gear ring and facilitates rotation of the inner hub with the selection collar.

11. A drive assembly for a multifunction rotary tool, the drive assembly comprising:

a driveshaft comprising a drive member and a tip portion slidably coupled with the drive member, the driveshaft being rotatable about a drive axis, the tip portion being slidable with respect to the drive member between a retracted position and an extended position;

an outer hub defining a first receptacle that defines a first centerline;

an inner hub disposed in the first receptacle and defining a second receptacle, the inner hub being rotatable with respect to the outer hub about the first centerline between a first position and a second position;

a stem at least partially disposed within the second receptacle and rotatably coupled with the inner hub, the stem being configured to receive a surface treatment device; wherein:

the driveshaft extends through a portion of each of the outer hub and the inner hub and into the second receptacle such that the stem is accessible to the tip portion to facilitate selective engagement between the tip portion and the stem;

when the tip portion of the driveshaft is in the retracted position, the tip portion is disengaged from the stem such that the stem is free to rotate with respect to the driveshaft; and when the tip portion of the driveshaft is in the extended position, the tip portion is engaged with the stem such that the stem rotates together with the driveshaft.

12. The drive assembly of claim 11 wherein the tip portion is biased into the extended position.

13. The drive assembly of claim 11 wherein the stem defines a slot for receiving the tip portion when the tip portion is in the extended position.

14. The drive assembly of claim 11 wherein:

the inner hub comprises a main body and a pair of shoulders disposed along an upper surface of the main body;

the pair of shoulders are spaced apart from each other and define a slot;

when the inner hub is in the first position, the tip portion is aligned with the slot such that the tip portion is in the extended position and is engaged with the stem;

when the inner hub is in the second position, the tip portion is misaligned with the slot and rests on the pair of shoulders such that the tip portion is in the retracted position and disengaged from the stem.

15. The drive assembly of claim 14 wherein when the inner hub is moved from the first position to the second position, the pair of shoulders urges the tip portion out of the slot and into the retracted position.

16. The drive assembly of claim 15 wherein at least one of the shoulders defines a chamfered edge and the tip portion defines a tapered edge that cooperate together to facilitate urging of the tip portion out of the slot and into the retracted position when the inner hub is moved from the first position to the second position.

17. The drive assembly of claim 11 wherein:

the first centerline is offset from the drive axis;

the second receptacle of the inner hub defines a second centerline that is offset from the first centerline;

the stem is rotatable with respect to the inner hub about the second centerline;

when the inner hub is in the first position the second centerline is coaxial with the drive axis; and when the inner hub is in the second position, the second centerline is offset from the drive axis.

18. A drive assembly for a multifunction rotary tool, the drive assembly comprising:

a driveshaft comprising a drive member and a tip portion slidably coupled with the drive member, the tip portion being slidable with respect to the drive member between a retracted position and an extended position;

a hub rotatably coupled with the driveshaft and rotatable between a first position and a second position, the hub comprising a main body and a pair of shoulders disposed along an upper surface of the main body and spaced from each other to define a slot, the upper surface defining an access hole between the pair of shoulders at the slot;

a stem rotatably coupled with the hub and configured to receive a surface treatment device; wherein:

when the hub is in the first position, the tip portion is aligned with the slot and is in the extended position, such that the tip portion extends through the access hole and into engagement with the stem; and when the hub is in the second position, the tip portion is misaligned with the slot and rests on the pair of shoulders in the retracted position such that the tip portion is disengaged from the stem.

19. The drive assembly of claim 18 wherein when the hub is moved from the first position to the second position, the pair of shoulders urges the tip portion out of the slot and into the retracted position.

20. The drive assembly of claim 19 wherein the tip portion is biased into the extended position by a spring.

* * * * *